US009079206B2

(12) United States Patent
Doulin et al.

(10) Patent No.: US 9,079,206 B2
(45) Date of Patent: Jul. 14, 2015

(54) SYSTEM FOR CLOSING A DEVICE FOR THE LOW-PRESSURE DISPENSING OF A PASTY LIQUID MATERIAL

(75) Inventors: Gwénaël Doulin, Saint Euphemie (FR); Pascal Hennemann, Claude (FR); Dominique Rusconi, Bresilley (FR)

(73) Assignee: PROMENS SA (FR)

( * ) Notice: Subject to any disclaimer, the term of this patent is extended or adjusted under 35 U.S.C. 154(b) by 77 days.

(21) Appl. No.: 14/122,342

(22) PCT Filed: May 25, 2012

(86) PCT No.: PCT/FR2012/051176

§ 371 (c)(1),
(2), (4) Date: Jun. 2, 2014

(87) PCT Pub. No.: WO2013/001193

PCT Pub. Date: Jan. 3, 2013

(65) Prior Publication Data

US 2014/0346195 A1 Nov. 27, 2014

(30) Foreign Application Priority Data

Jun. 27, 2011 (FR) ..... 11 55686

(51) Int. Cl.
*B65D 37/00* (2006.01)
*B05B 11/00* (2006.01)

(52) U.S. Cl.
CPC ..... *B05B 11/3035* (2013.01); *B05B 11/0067* (2013.01); *B05B 11/0072* (2013.01);
(Continued)

(58) Field of Classification Search
CPC ..... B05B 11/3035; B05B 11/3036; B05B 11/3039; B05B 11/304; B05B 11/3052; B05B 11/3069; B05B 11/3061; B05B 11/0067; B05B 11/0072
USPC ..... 222/207, 308, 402.1, 321.3, 321.7, 222/321.9, 209, 211, 213
See application file for complete search history.

(56) References Cited

U.S. PATENT DOCUMENTS 3,141,580 A * 7/1964 Rogers ..... 222/213
5,114,052 A * 5/1992 Tiramani et al. ..... 222/207

(Continued)

FOREIGN PATENT DOCUMENTS

JP 07052980 2/1995
JP 20060235833 3/2008

(Continued)

OTHER PUBLICATIONS

International Search Report for corresponding application PCT/FR2012/051176 filed on May 25, 2012; Mail date Oct. 8, 2012.

*Primary Examiner* — Lien Ngo
(74) *Attorney, Agent, or Firm* — Cantor Colburn LLP

(57) ABSTRACT

The invention relates to a device (1) for dispensing a pasty liquid material (2) by means of a low-pressure manual metering pump (5), which is provided with an system for closing an end (32), and which is intended for a rigid or flexible container (4), the operation of said pump being ensured by: a lower check valve (11) and a metering chamber (10) which consists of a resiliently deformable bellows (9) and which is in communication with an upper valve (14) consisting of in series: a stopper (16) for the channel (13) of the spout (8), which ensures that the end (32) is closed; a resiliently deformable diaphragm (15) enabling the stopper (16) to be opened; an auxiliary return member (17) suitable for the low pressures causing the closing of the stopper (16); and a sealed vessel (18), characterized in that the resiliently deformable diaphragm (15) is combined with the vessel (18) that said diaphragm seals, wherein the auxiliary return member (17) is arranged inside said vessel so as to be permanently linked to the diaphragm (15), and said vessel includes two levels (19, 20) that are resiliently deformable according to various characteristics.

12 Claims, 6 Drawing Sheets

Figure 1:
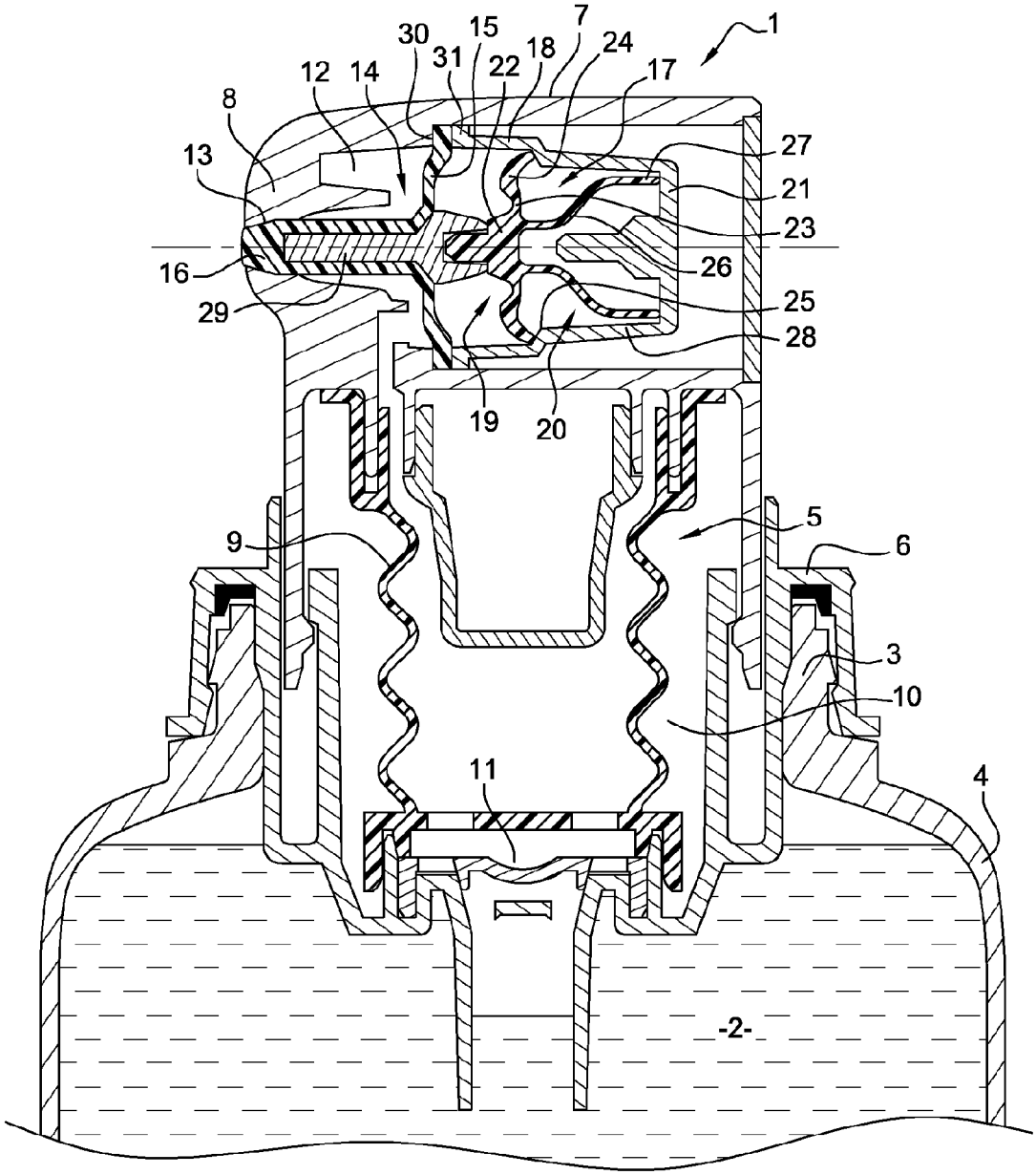

(52) U.S. Cl.
CPC ..... *B05B11/3036* (2013.01); *B05B 11/3052* (2013.01); *B05B 11/3061* (2013.01); *B05B 11/3069* (2013.01)

(56) References Cited

U.S. PATENT DOCUMENTS 5,819,990 A 10/1998 Cimentepe et al.
6,371,333 B2 * 4/2002 Lorscheidt et al. ..... 222/321.9
6,557,736 B1 * 5/2003 Ophardt ..... 222/321.9
7,111,761 B2 * 9/2006 Masuda ..... 222/321.7
8,500,416 B2 * 8/2013 Ophardt et al. ..... 417/245
8,528,792 B2 * 9/2013 Ophardt et al. ..... 222/321.6
2010/0102090 A1 * 4/2010 Hummel ..... 222/153.13

FOREIGN PATENT DOCUMENTS

WO 2009008675 1/2009
WO 2010106256 A1 9/2010

* cited by examiner

SYSTEM FOR CLOSING A DEVICE FOR THE LOW-PRESSURE DISPENSING OF A PASTY LIQUID MATERIAL

The present invention concerns a dispensing device equipped with an end-closure system for liquid to pasty products which do not contain any preserving agents, composed of a pump and push button fitted with end closing means.

It is known to dispense this type of product using pumps operating at high pressure, in particular in the pharmaceutical field e.g. for preservative-free nasal sprays. These pumps have operating pressures ranging from 3 to 7 bars. This has the disadvantage of dispensing small doses (smaller than 0.5 ml) due to the small cross-sections of the metering chambers needed to generate these high pressures.

However some products and some uses require larger metering. This is why, in these cases, recourse is had to pumps operating at low pressure i.e. lower than 2 bars.

Nonetheless this type of pump has the drawback of requiring low forces for end-closure which leads to the use of large-size shut-off valves and valve return members adapted to low pressures, making them sensitive to differences in external atmospheric pressure. This may cause undue opening of the valves causing the inadvertent dispensing of product and/or accidental bacterial back-contamination of the product since the product is not protected by anti-bacterial preserving agents.

This latter type of pump is intended to be placed on the open end of a rigid or flexible container containing the product to be dispensed in predetermined quantity.

The said pump generally comprises:

- a base element added onto the container;
- resiliently deformable bellows defining a metering chamber arranged in connection with:
- a push button mounted telescopically on the base element, comprising:
- an end-closure system ensuring the functioning of the said pump and formed by:
- a lower check valve in connection with the base element allowing the passing of the product towards:
- a metering chamber composed of the resiliently deformable bellows of variable volume communicating with:
- an upper check valve consecutively formed by: a stopper plugging the spout channel to ensure closure of an end; a resiliently deformable diaphragm able to be urged into deformation by the product when the pump is actuated allowing the stopper to be opened; an auxiliary return member adapted to low pressures prompting closure of the stopper; and a hermetically sealed vessel.

According to the invention in order to remedy the initially cited shortcomings in devices of this type, the resiliently deformable diaphragm forming the upper valve is associated with a vessel which it seals hermetically, and inside which there is axially arranged the auxiliary return member in permanent connection with the diaphragm and comprising two resiliently deformable levels having different characteristics, the first level maintaining a permanent return force of predetermined value against the said diaphragm and therefore on the stopper of the spout channel, the second level being interpositioned between the first stage and the bottom of the vessel and maintaining a return force greater than that of the first level, and only acting when load is applied to the diaphragm, or conversely.

The present invention also concerns the characteristics which will become apparent throughout the following description and which are to be considered either alone or in any possible technical combination thereof.

Figure 2:
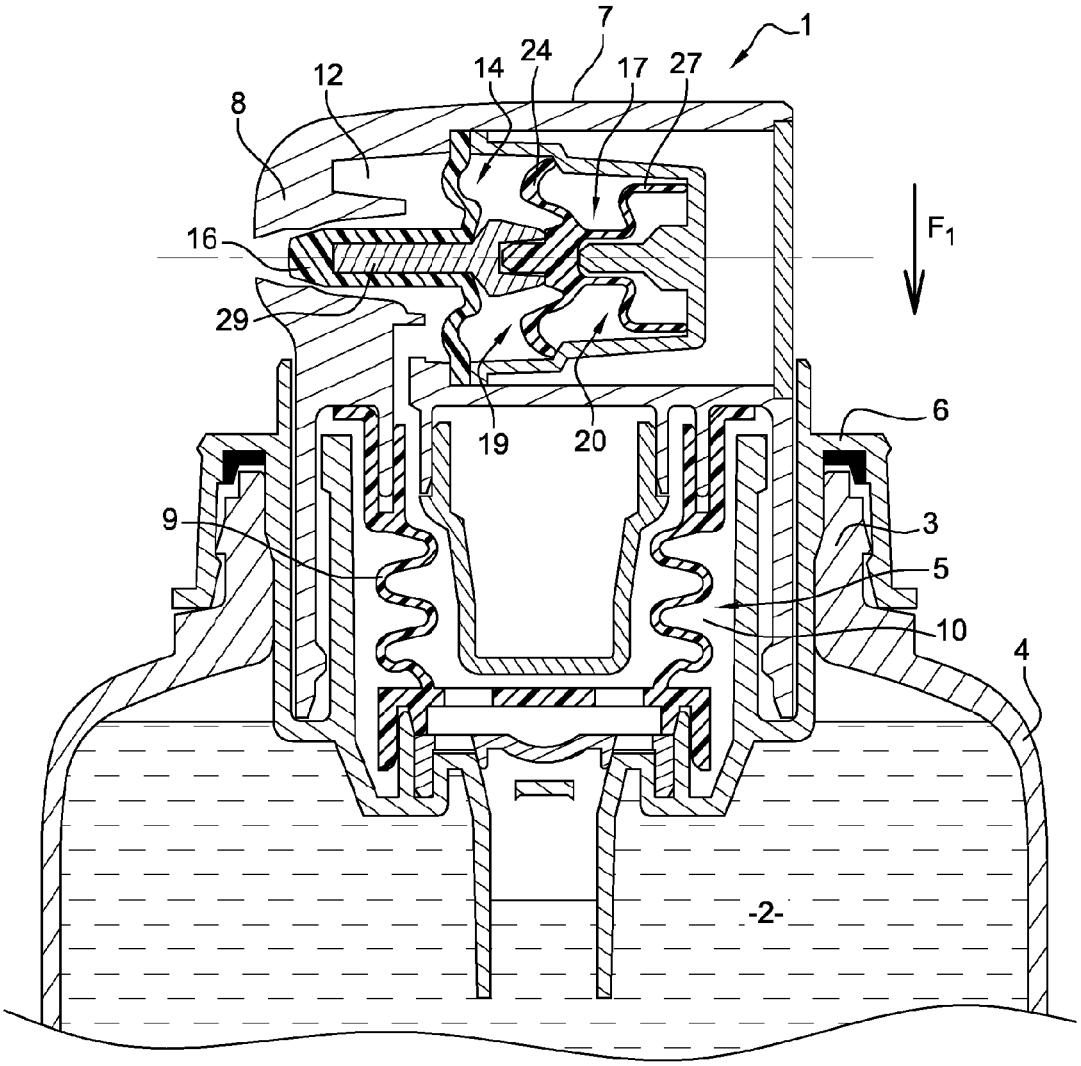
Figure 3:
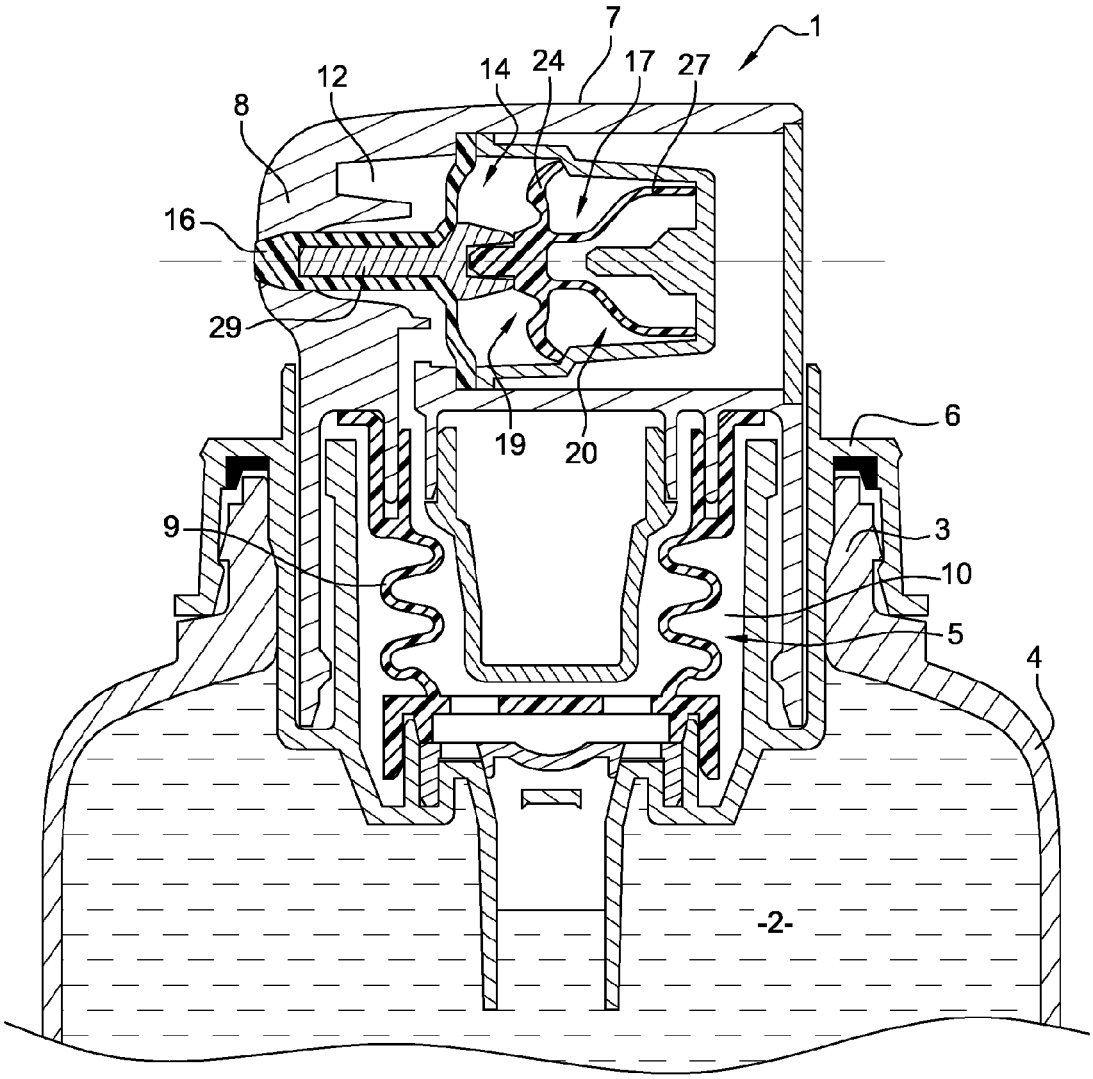
Figure 4:
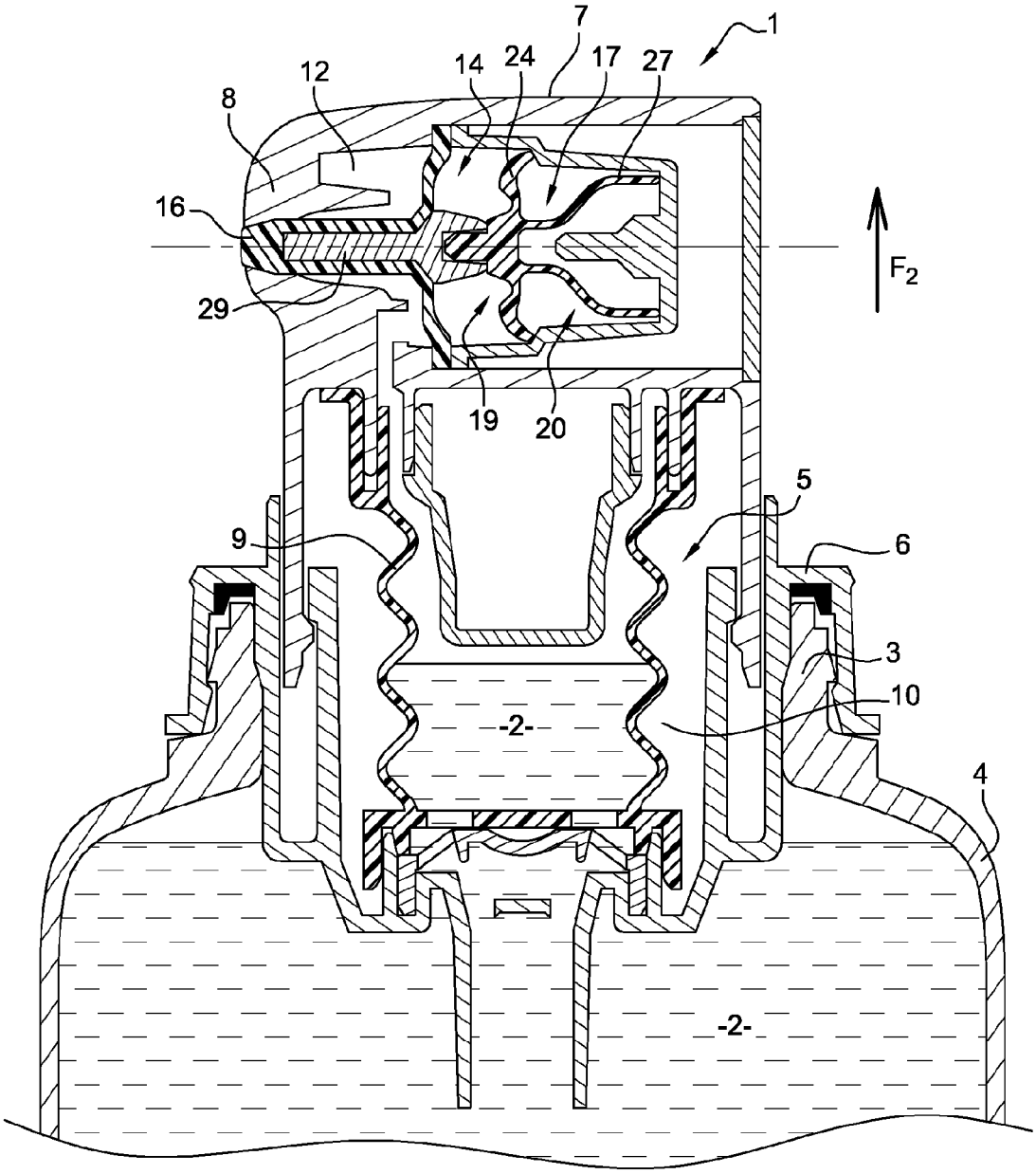
Figure 5:
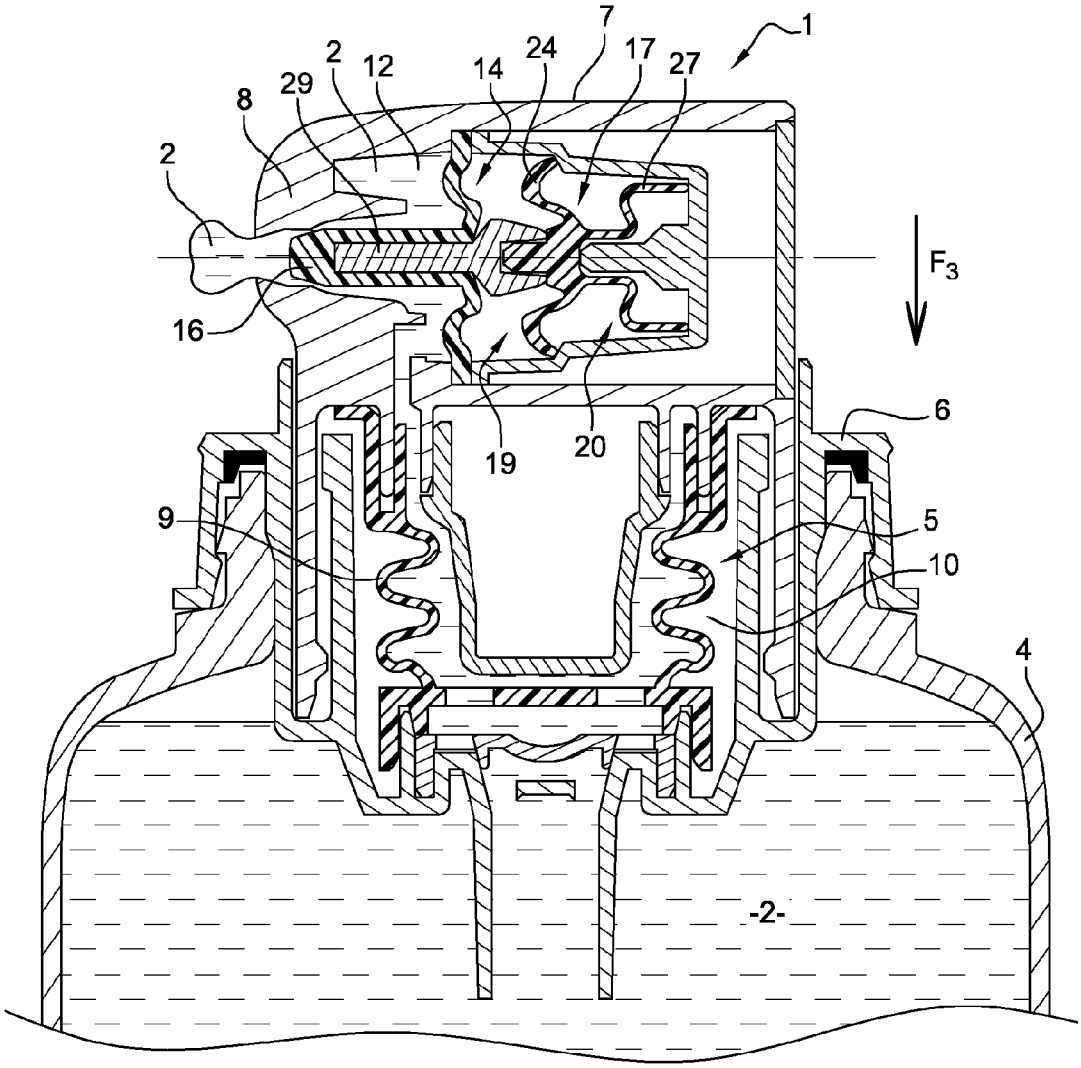
Figure 6:
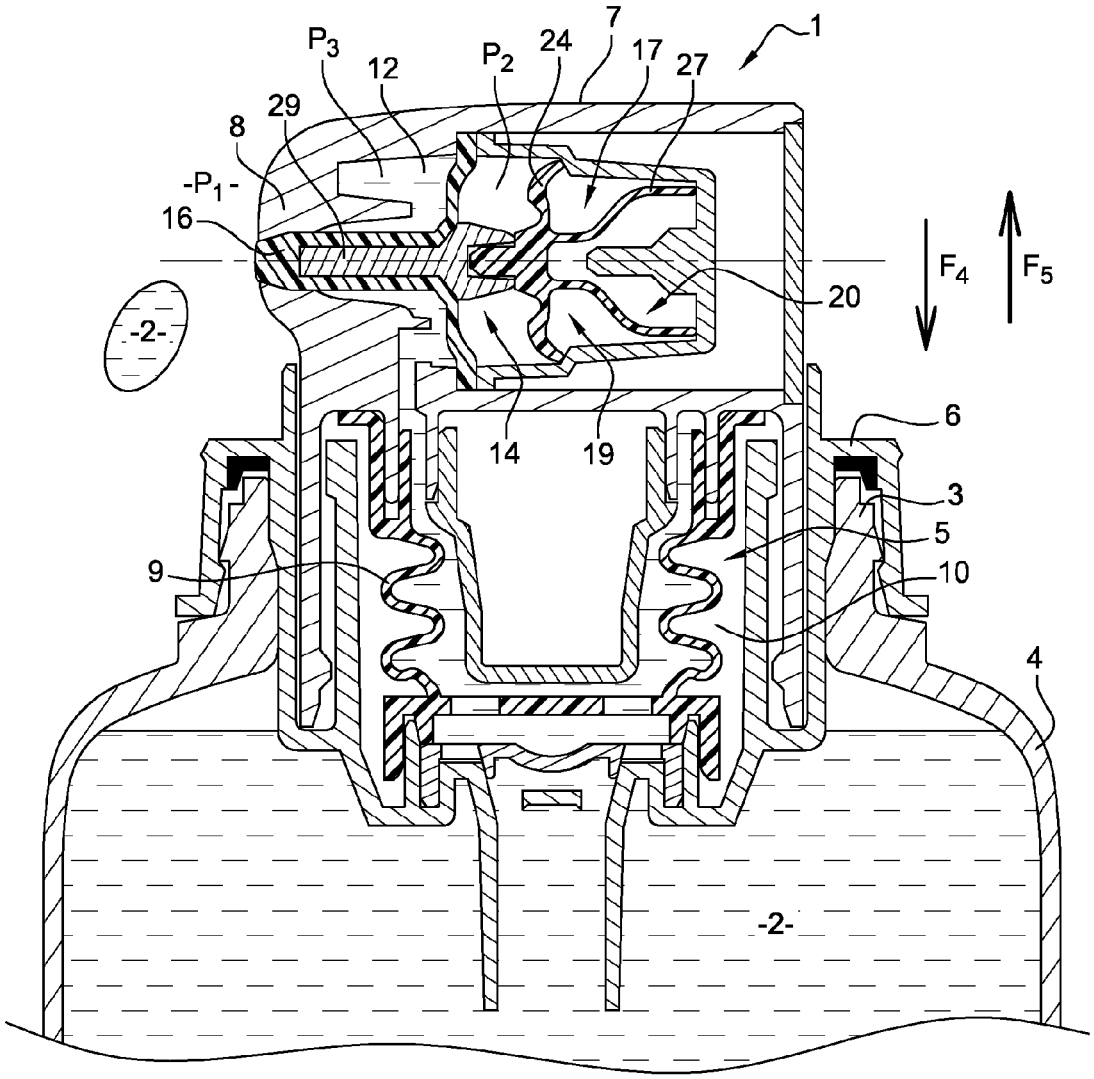

This description given by way of a non-limiting example will give a better comprehension of how the invention can be implemented with reference to the appended drawings in which:

All the Figures are axial cross-sectional views of a dispensing pump according to the invention arranged on a container containing a product to be dispensed, and showing the pump as follows:

FIG. 1: before first use;

FIG. 2: during a first priming phase of the pump i.e. by pushing downwards F1 on the push button which causes a reduction in volume of the metering chamber by compressing the bellows and the opening of the upper valve by increasing the air pressure on the diaphragm which itself leads to compression of the auxiliary return member;

FIG. 3: at a second priming phase of the pump i.e. in the state in which the push button is in bottom position when the upper valve closes firstly through reduction in the air pressure on the diaphragm and secondly through the force applied by the auxiliary return member;

FIG. 4: at a third priming phase of the pump i.e. when the press button is lifted F2 under the action of the elastic return force of the bellows, the effect of which is to increase the volume of the metering chamber causing a pressure drop in this same chamber and opening of the lower valve enabling the product to rise up in the metering chamber formed by the bellows; this same pressure drop has the effect of reinforcing the closing of the upper valve via action on its resiliently deformable diaphragm;

FIG. 5: at a fourth priming phase of the pump i.e. during first dispensing of the product, by again pushing down F3 the push button which causes a reduction in volume of the metering chamber by compressing the bellows and opening of the upper valve by increasing the pressure of the product to be dispensed on the diaphragm, itself leading to compression of the auxiliary return member and emerging of the product via the dispensing spout;

FIG. 6: at a fifth and last priming phase i.e. the state in which the push button is in bottom position when the upper valve closes firstly via a decrease in the pressure of the product to be dispensed on the diaphragm, and secondly via the force applied by the auxiliary return member. After this last phase and lifting F5 of the push button as described in FIG. 4, the device is on standby for further dispensing of the product by pressing downwardly on the push button according to F4 and its subsequent lifting according to F5.

The device globally designated 1 in the Figures is intended for dispensing a liquid to pasty liquid 2 via a metering pump 5 equipped with a system for closing an end 32 placed on the open end 3 of a rigid or flexible container 4 containing the product 2 to be dispensed in predetermined quantity.

The manual low-pressure metering pump 5 comprises:

- a base element 6 added onto the container 4;
- resiliently deformable bellows 9 defining a metering chamber 10 arranged in connection with:
- a push button 7 mounted telescopically on the base element 6, comprising:
- a system for closing an end 32 ensuring the functioning of the said pump and formed by:
- a lower check valve 11 in connection with the base element 6 allowing the passing of the product 2 towards:
- a metering chamber 10 composed of the resiliently deformable bellows 9 of variable volume communicating with:
- an upper check valve 14 consecutively formed by: a stopper 16 to plug the channel 13 of the spout 8 ensuring closing of the end 32; a resiliently deformable diaphragm 15 able to be urged into deformation by the product 2 when the pump 5 is actuated allowing the stopper 16 to open; an auxiliary return member 17 adapted to low pressures prompting the closing of the stopper 16 and a hermetic vessel 18.

According to the invention, the resiliently deformable diaphragm 15 forming the upper valve 14 is associated with a vessel 18 which it seals hermetically, and inside which there is axially arranged the auxiliary return member 17. This member is in permanent connection with the diaphragm 15 and comprises two resiliently deformable levels 19, 20 having different characteristics.

The first level 19 maintains a permanent return force of predetermined value against the said diaphragm 15 and therefore on the stopper 16 of the channel 13 of the spout 8. The second level 20 is inter-positioned between the first level 19 and the bottom 21 of the vessel 18, and maintains a return force greater than that of the first level 19 and only acting when load is applied to the diaphragm 15, or conversely.

The first and second levels 19, 20 could have different characteristics but identical geometries; but according to this example of embodiment they have different characteristics and different geometries.

Therefore the first and second levels 19, 20 forming the auxiliary return member 17 originate from a central core 22, the first level 19 extending radially around it and having first an elastically hinged inner peripheral region 23 close to the core 22 and being continued by an outer peripheral region 24 bearing upon the inner wall 25 of the vessel 18, the second level 20 extending axially from the same central core 22 and forming a bell whose inner peripheral region 26 close to the core 22 forms an elastic hinge extended by an outer peripheral region 27 bearing upon the bottom 21 of the vessel 18 and able also to bear upon the inner wall 28 thereof when load is applied to the diaphragm 13.

First, since the vessel 18 is hermetically sealed, it is a fact that when the device is at rest the pressure P2 of the vessel 18 is equivalent to the pressure of ambient air at the time of initial assembly of the device 1, i.e. equivalent to atmospheric pressure. Secondly since the container 4 necessarily has a variable volume through its functioning with no air intake and the lower valve 11 cannot be fully sealed, it is a fact that the pressure P3 of the metering chamber 12 follows changes in the pressure of the environment P1.

On this account, when the push button 7 is lifted up or when the device 1 is placed in an environment of low pressure P1 (P1 lower than atmospheric pressure) for example when travelling in an aircraft, the pressure P3 of the metering chamber decreases and becomes lower than initial atmospheric pressure, and hence lower than P2 which remains invariable and hence equivalent to atmospheric pressure since maintained hermetically inside the vessel 18.

$$P1 \leq P3 < P2 = \text{atmospheric } P.$$

The difference in pressure between P3 and P2 generates a force on the diaphragm 15, thereby reinforcing the bearing upon the stopper 16, and hence reinforcing the seal.

According to the present example of embodiment the outer peripheral regions 24, 27 of the first and second levels 19, of the auxiliary return member 17 extending their inner peripheral regions 23, 26 are continuous.

However they could also form hinge arms.

The auxiliary return member 17 formed by the first and second levels 19, 20 is made in a single piece by moulding a thermoplastic elastomer material (TPE) or thermoplastic vulcanizate (TPV) or silicon-based material or any other material offering similar characteristics.

Similarly, the resiliently deformable diaphragm 15 and its stopper 16 forming part of the upper valve 14 are made in a single piece by moulding a thermoplastic elastomer material (TPE) or thermoplastic vulcanizate (TPV) or silicon-based material or any other material offering similar characteristics.

According to another characteristic of the invention, the stopper 16 of the resiliently deformable diaphragm 15 forming part of the upper valve 14 is reinforced by a rigid inner core emerging from said diaphragm 15 and mechanically linked with the first level 19 of the auxiliary return member 17.

Preferably, the resiliently deformable diaphragm 15 and its stopper 16 forming part of the upper valve 14 and the rigid inner core 29 are obtained by bi-material injection.

According to the present construction, the resiliently deformable diaphragm 15 forming part of the upper valve 14 is held clamped against the vessel 18, between a shoulder 30 of the push button 7 and a peripheral region 31 of said vessel 18.

The constituent material of the push button 7, the resiliently deformable diaphragm 15, the resiliently deformable bellows 9, the lower valve 11 and the base element 6 contains antibacterial agents.

The invention claimed is:

1. A device for dispensing a liquid to pasty product via a manual metering pump operating at low pressure and equipped with an end-closure system intended to be placed on the open end of a rigid or flexible container containing the product to be dispensed in predetermined quantity, the said pump comprising:

a base element added onto the container;

resiliently deformable bellows defining a metering chamber arranged connected to:

a push button telescopically mounted on the base element, comprising:

the end-closure system ensuring the functioning of the said pump and formed by:

a lower check valve in connection with the base element, allowing the passing of the product towards:

the metering chamber composed of the resiliently deformable bellows of variable volume, communicating with:

an upper check valve consecutively formed by: a stopper plugging a channel of a spout ensuring closure of the end; a resiliently deformable diaphragm able to be urged to deform by the product when the pump is actuated allowing the opening of the stopper; an auxiliary return member adapted to low pressures prompting closure of the stopper and a hermetic vessel, wherein the resiliently deformable diaphragm is associated with the vessel that it seals hermetically, and inside which there is axially arranged the auxiliary return member in permanent connection with the diaphragm and comprising two resiliently deformable levels (19, 20) having different characteristics, the first level maintaining a permanent return force of predetermined value against the said diaphragm and hence on the stopper of the channel of the spout, the second level being inter-positioned between the first level and the bottom of the vessel and maintaining a return force greater than that of the first level, only acting when load is applied to the diaphragm, or conversely.

2. The device according to claim 1, wherein the first and second levels have different characteristics and different geometries.

3. The device according to claim 1, wherein the first and second levels have different characteristics but have identical geometries.

4. The device according to claim 2, wherein the first and second levels forming the auxiliary return member originate from a central core, the first level extending radially thereabout and having first an elastically hinged inner peripheral region close to the core and continued by an outer peripheral region bearing upon the inner wall of the vessel, the second level extending axially from the same central core and forming a bell whose inner peripheral region close to the core forms an elastic hinge extended by an outer peripheral region bearing upon the bottom of the vessel and able also to bear upon the inner wall thereof when load is applied to the diaphragm.

5. The device according to claim 4, wherein the outer peripheral regions of the first and second levels of the auxiliary return member extending their inner peripheral regions are continuous.

6. The device according to claim 4, wherein the outer peripheral regions of the first and second levels of the auxiliary return member extending their inner peripheral regions form hinge arms.

7. The device according to claim 1, wherein the auxiliary return member formed by the first and second levels is made in a single piece by moulding thermoplastic elastomer material or thermoplastic vulcanizate.

8. The device according to claim 1, wherein the resiliently deformable diaphragm and its stopper forming part of the upper valve are made in a single piece by moulding a thermoplastic elastomer material or thermoplastic vulcanizate.

9. The device according to claim 2, wherein the stopper of the resiliently deformable diaphragm forming part of the upper valve is reinforced by a rigid inner core emerging from said diaphragm and mechanically linked with the first level of the auxiliary return member.

10. The device according to claim 9, wherein the resiliently deformable diaphragm and its stopper forming part of the upper valve and the rigid inner core are obtained by bimaterial injection.

11. The device according to claim 1, wherein the resiliently deformable diaphragm forming part of the upper valve is held clamped against the vessel between a shoulder of the push button and a peripheral region of the said vessel.

12. The device according to claim 1, wherein the constituent material of the push button, the resiliently deformable diaphragm, the resiliently deformable bellows, the lower valve and the base element contains antibacterial agents.

* * * * *